US010202877B2

(12) United States Patent
Junge

(10) Patent No.: US 10,202,877 B2
(45) Date of Patent: Feb. 12, 2019

(54) CAMSHAFT HAVING AN AXIALLY GUIDED SLIDING ELEMENT

(71) Applicant: ThyssenKrupp Presta TecCenter AG, Eschen (LI)

(72) Inventor: Volker Junge, Wernigerode (DE)

(73) Assignee: THYSSENKRUPP PRESTA TECCENTER AG, Eschen (LI)

( * ) Notice: Subject to any disclaimer, the term of this patent is extended or adjusted under 35 U.S.C. 154(b) by 65 days.

(21) Appl. No.: 15/524,353

(22) PCT Filed: Aug. 4, 2015

(86) PCT No.: PCT/EP2015/067880

§ 371 (c)(1),
(2) Date: May 4, 2017

(87) PCT Pub. No.: WO2016/071019

PCT Pub. Date: May 12, 2016

(65) Prior Publication Data

US 2017/0321577 A1 Nov. 9, 2017

(30) Foreign Application Priority Data

Nov. 7, 2014 (DE) ..... 10 2014 116 252

(51) Int. Cl.
*F01L 1/047* (2006.01)
*F01L 1/344* (2006.01)
(Continued)

(52) U.S. Cl.
CPC ..... *F01L 1/34406* (2013.01); *F01L 1/047* (2013.01); *F01L 1/053* (2013.01); *F01L 1/34409* (2013.01);
(Continued)

(58) Field of Classification Search
CPC ..... F01L 2001/0473; F01L 1/46; F01L 2013/0052
(Continued)

(56) References Cited

U.S. PATENT DOCUMENTS 7,069,892 B2 7/2006 Lechner et al.
2012/0260870 A1* 10/2012 Wahl ..... F01L 1/053 123/90.6
(Continued)

FOREIGN PATENT DOCUMENTS

CN 1467393 A 1/2004
CN 202810984 U 3/2013
(Continued)

OTHER PUBLICATIONS

English translation of International Search Report issued in PCT/EP2015/67880 dated Nov. 23, 2015 (dated Dec. 8, 2015).
(Continued)

*Primary Examiner* — Jorge Leon, Jr.
(74) *Attorney, Agent, or Firm* — Thyssenkrupp North America, Inc.

(57) ABSTRACT

A camshaft may include a shaft as well as a sliding element that is disposed on the shaft such that the sliding element is axially displaceable along a shaft axis. The shaft may comprise an external tooth for transmitting torque between the shaft and the sliding element. The external tooth may engage a mating tooth geometry formed in a passage of the sliding element. The sliding element on its axial end faces may comprise bearing collars that with the shaft form radial supporting bearings of the sliding element on the shaft. Further, the shaft may comprise cylindrical bearing portions for forming the radial supporting bearings, wherein the bearing portions can be configured with a diameter that is smaller than a diameter circumscribed by tips of the mating
(Continued)

tooth geometry that protrude into the passage of the sliding element.

10 Claims, 2 Drawing Sheets

(51) Int. Cl.
*F01L 13/00* (2006.01)
*F01L 1/053* (2006.01)
*F01L 1/46* (2006.01)

(52) U.S. Cl.
CPC ..... *F01L 13/0036* (2013.01); *F01L 13/0042* (2013.01); *F01L 1/46* (2013.01); *F01L 2001/0473* (2013.01); *F01L 2001/0476* (2013.01); *F01L 2013/0052* (2013.01)

(58) Field of Classification Search
USPC ..... 123/90.18
See application file for complete search history.

(56) References Cited

U.S. PATENT DOCUMENTS

2013/0000442 A1* 1/2013 Wiesner ..... F01L 13/0036 74/567
2013/0047944 A1* 2/2013 Schwarzenthal ..... F01L 1/047 123/90.18
2013/0247711 A1* 9/2013 Manteufel ..... F16H 25/12 74/567
2014/0076256 A1* 3/2014 Gunnel ..... F01L 13/0036 123/90.17

FOREIGN PATENT DOCUMENTS

| | | | |
|---|---|---|---|
| CN | 103688027 | A | 3/2014 |
| CN | 103732866 | A | 4/2014 |
| DE | 102008028513 | A | 12/2009 |
| DE | 102009014895 | A | 10/2010 |
| DE | 102010004591 | A | 7/2011 |
| DE | 102011001659 | A | 10/2012 |
| DE | 102011052912 | A | 2/2013 |
| DE | 102011086161 | A | 5/2013 |
| DE | 102011086162 | A | 5/2013 |
| DE | 102012103581 | A | 10/2013 |
| JP | 2011-529552 | A | 12/2011 |
| WO | 2010142408 | A | 12/2010 |

OTHER PUBLICATIONS

English abstract of DE102009014895.
English abstract of DE102008028513.
English abstract of DE102010004591.
English abstract of DE102011086161.
English abstract of DE102011086162.
Machine translation of Japanese office action issued in Japanese patent application No. 2017-523859, dated Dec. 4, 2018.

* cited by examiner

CAMSHAFT HAVING AN AXIALLY GUIDED SLIDING ELEMENT

CROSS REFERENCE TO RELATED APPLICATIONS

This application is a U.S. National Stage Entry of International Patent Application Serial Number PCT/EP2015/067880, filed Aug. 4, 2015, which claims priority to German Patent Application No. DE 10 2014 116 252.8 filed Nov. 7, 2014, the entire contents of both of which are incorporated herein by reference.

FIELD

The present disclosure generally relates to camshafts, including camshafts with axially-guided sliding elements.

BACKGROUND

DE 10 2011 086 161 A1 discloses a camshaft with a basic shaft, and with a sliding element received on the basic shaft in such a way as to be axially displaceable along the shaft axis of the camshaft. The basic shaft comprises an outer longitudinal tooth structure with a multiplicity of external teeth, and the external teeth engage in a mating tooth geometry formed in a passage in the sliding element. In this way, the sliding element is axially displaceable on the basic shaft in the direction of the shaft axis, and yet the sliding element cannot be rotated on the basic shaft, such that torques can be transmitted from the basic shaft to the sliding element.

When sliding elements are received on a basic shaft provided with external teeth, the fundamental problem arises of guiding the sliding element as far as possible without play. In order to ensure that lift information is picked off continuously in a manner free of disturbances from a cam track of the sliding element to a pick-off element, the sliding element must be guided on the basic shaft as far as possible without radial play. Guiding the sliding element with minimal play on the basic shaft minimizes the axial offset of the sliding element on the basic shaft, and it is desirable for the axial offset to be as small as possible.

To ensure that a guiding of the sliding element on the basic shaft is decoupled from the meshing of the external teeth of the basic shaft with the inner tooth structure in the sliding element for forming the mating tooth geometry, DE 10 2011 086 161 A1 proposes the provision of bearing collars on the sliding element, through which the sliding element is guided on the basic shaft so as to minimize the axial offset. The bearing collars on the sliding element in this case run against the tooth tips of the external teeth of the basic shaft, as a result of which, however, early wear of the bearing collars may be caused. If bearing points with a cylindrical shape were to be provided on the basic shaft, the sliding element could no longer be mounted with the mating tooth geometry, since the mating tooth geometry in the passage of the sliding element has a smallest diameter that would be smaller than the cylinder portion for guiding the sliding element which is formed on the basic shaft.

DETAILED DESCRIPTION

Figure 1:
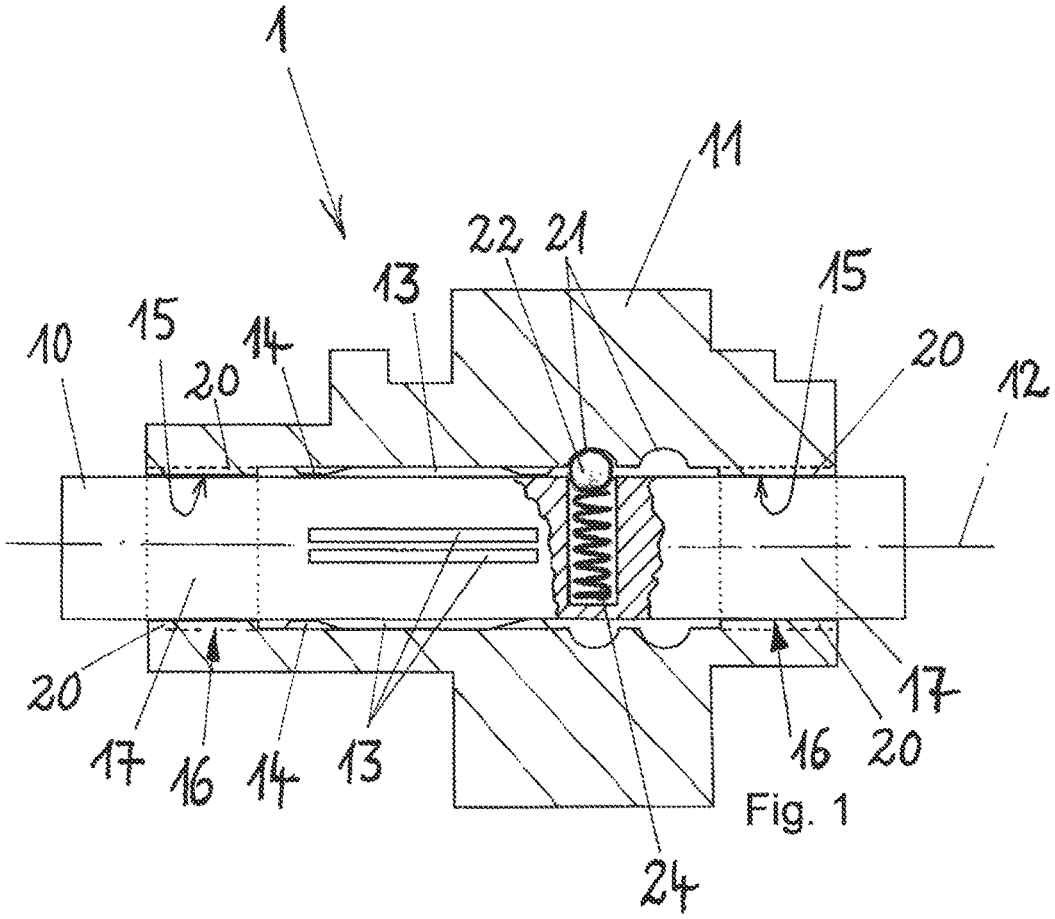
FIG. 1 is a cross-sectional view of part of an example camshaft with a radial supporting bearing.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

One example object of the present disclosure is to develop a camshaft with a minimized axial offset of an axially displaceable sliding element on the basic shaft, wherein the sliding element is intended to be guided radially against the basic shaft via bearing collars. Further, at least in some examples, the present disclosure generally relates to a camshaft with a basic shaft, on which at least one sliding element is received in such a way as to be axially displaceable along a shaft axis, wherein the basic shaft comprises at least one external tooth for the transmission of torque between the basic shaft and the sliding element, which external tooth engages in a mating tooth geometry formed in a passage of the sliding element, wherein the sliding element, on its axial end faces, comprises a respective bearing collar which, with the basic shaft, forms a radial supporting bearing of the sliding element on the basic shaft.

To achieve this object, the invention proposes that the basic shaft comprises cylindrical bearing portions for forming the supporting bearing, wherein the bearing portions are configured with a diameter that is smaller than a tip diameter, which protrudes into the passage, of the mating tooth geometry in the sliding element.

The inventive configuration of the supporting bearing of the sliding element on the basic shaft affords the advantage that the sliding element can be easily mounted on the basic shaft, and the bearing collars of the supporting bearing do not run against the at least one tooth tip of the external tooth on the basic shaft. The bearing portion on the basic shaft can be configured cylindrically about the complete circumference, and the diameter of the bearing portions can, for example, be smaller than or match the root diameter of the at least one external tooth or several external teeth on the basic shaft. Depending on the diameter of the cylindrical bearing portions of the basic shaft, the bearing collars can also be configured with substantially the same diameter, and the diameter of the bearing collars can, for example, be only slightly greater than the diameter of the cylindrical bearing portion, in order to form a plain bearing with a conventional bearing clearance.

The mating tooth geometry can be configured in different ways depending on the configuration and the number of the one or more external teeth. If several external teeth are present in particular about the complete circumference on the basic shaft and thus form an outer tooth structure, the mating tooth geometry can be configured as an inner tooth structure. The tip diameter of the mating tooth geometry can then be formed as the tip diameter of the inner tooth structure, which forms the diameter with which the tooth tips protrude into the passage in the sliding element. For example, if external teeth are provided only individually, the mating tooth geometry can alternatively also be formed by a hollow cylindrical portion with at least one tooth notch formed in the latter, and a respective external tooth of the basic shaft engages in the tooth notch or in each of the tooth notches. The hollow cylindrical portion can in this case have a diameter that is greater than the diameter of the bearing collars in the passage of the sliding element. In other words, the bearing collars of the sliding element can have a bearing internal diameter that is smaller than the internal diameter of the hollow cylindrical portion. In this way, two bearing points spaced apart from each other are formed for supporting the sliding element on the basic shaft in order to permit defined guiding of the sliding element.

Moreover, the cylindrical bearing portions of the basic shaft can have an external diameter that is smaller than the internal diameter of the hollow cylindrical portion in the sliding element. This ensures that the sliding element can be mounted on the basic shaft by pushing the sliding element onto the basic shaft in the direction of the shaft axis. To allow the bearing collars to be guided over the cylindrical bearing portions without the hollow cylindrical portion in the sliding element preventing the axial advance of the sliding element on the basic shaft, the diameter of the hollow cylindrical portion in the sliding element is chosen to be greater than the diameter of the cylindrical bearing portions of the basic shaft.

Particularly advantageously, the bearing collars can comprise at least one mounting notch through which an external tooth of the basic shaft can be guided when the sliding element is guided onto the basic shaft. The sliding element can be guided onto the basic shaft only when at least one mounting notch is formed in the bearing collar such that the at least one external tooth present on the basic shaft can migrate axially through the mounting notch during the pushing-on of the sliding element. The camshaft according to the invention should therefore comprise at least one external tooth, but preferably two, three or four external teeth, for example, such that the number of the mounting notches is limited as a function of the number of the external teeth. For example, four external teeth can be mounted on the basic shaft and distributed uniformly on the circumference, such that four uniformly distributed mounting notches are provided in the bearing collar. To support the sliding element on the basic shaft, the bearing collar thus comprises interruptions, wherein the axial guiding of the sliding element on the basic shaft over the bearing collar, which runs against the cylindrical bearing portion of the basic shaft, is not adversely affected by the mounting notches.

Particularly advantageously, the tooth notches in the hollow cylindrical portion of the sliding element and the mounting notches in the bearing collars of the sliding element can be aligned with each other in the direction of the shaft axis, such that the tooth notches and the mounting notches are in mutually identical circumferential positions.

Viewed in the direction of the shaft axis, the external teeth on the basic shaft can be shorter than the distance between the bearing collars of the sliding element. In particular, between one bearing collar of the sliding element and the mating tooth geometry, i.e. the hollow cylindrical portion, at least two latch grooves can be formed in the passage of the sliding element, and a latching element, which is received on the basic shaft, can latch into these latch grooves. In this way, defined axial positions of the sliding element on the basic shaft can be created when the sliding element is adjusted, by an external actuator, in the axial position on the basic shaft. The latching element can be formed, for example, by a ball which is pressed into the latch groove by a compression spring.

For manufacturing reasons, it may be particularly advantageous if the external diameter of the portion of the basic shaft in which the external tooth or the external teeth are arranged and the external diameter of the bearing portions are configured with identical dimensions. This affords manufacturing advantages, particularly if the external teeth are not formed integrally with the basic shaft and instead, for example, are subsequently arranged thereon, for example by force-fit and/or form-fit engagement or by an integral bond.

Finally, the sliding element can comprise a carrier tube, wherein the bearing collars are formed on the axial end faces of the carrier tube. Alternatively, it is possible to provide the bearing collars on at least one cam element which is received on the carrier tube and which can protrude beyond the carrier tube, in the direction of the shaft axis, and the cam element with its protruding portion can form the bearing collar on the inside.

According to a modified embodiment, the sliding element can also be integrally formed. The elements of the sliding element, at least comprising the cam elements and for example the adjustment member, can be produced from one piece or can be joined to each other by a joining method. A carrier tube can in this case be omitted, and the mating tooth geometry in the passage of the sliding element can be formed in the one-piece body. Thus, the bearing collars can also be formed in the passage of the one-piece sliding element.

FIG. 1 shows a cross-sectional view of a camshaft 1 with a basic shaft 10 which extends along a shaft axis 12, wherein a sliding element 11, which is shown only schematically and in a simplified manner, is mounted on the basic shaft 10. The sliding element 11 comprises cam tracks, via which lift information can be transmitted to a valve of an internal combustion engine. To control the valve with different cam tracks, the sliding element 11 can be displaced on the basic shaft 10 in the direction of the shaft axis and, in order to generate discrete axial positions of the sliding element 11 on the basic shaft 10, a latching element 22 is used which is pretensioned with a compression spring 24 and is configured, for example, as a latching ball that can latch into latch grooves 21 formed in a passage in the sliding element 11.

For the transmission of torque between the basic shaft 10 and the sliding element 11, the basic shaft 10 comprises external teeth 13 shown by way of example, and the basic shaft 10 comprises, according to the embodiment shown, eight external teeth 13 which are mounted in pairs at 90° positions on the circumference of the basic shaft 10. In a modification of the illustrated distribution of the external teeth 13 on the basic shaft 10, these can also be arranged twice individually or twice in pairs at positions lying 180° opposite each other on the basic shaft 10, in which case, for example, a triple arrangement with a division of 120° distributed uniformly about the circumference is also advantageously possible.

The external teeth 13 engage in a mating tooth geometry 14 formed in the sliding element 11, such that a force can be transmitted via the flanks of the external teeth 13 and of the mating tooth geometry 14 in the circumferential direction. In this way, a torque can be transmitted between the basic shaft 10 and the sliding element 11, such that the sliding element 11 is not rotatable on the basic shaft 10, but the sliding element 11 is guided axially on the basic shaft 10 in the direction of the shaft axis.

The guiding is effected via bearing collars 15 which, viewed axially, are formed adjacent to the outsides within the sliding element 11. The bearing collars 15 run against bearing portions 17, which are formed by corresponding cylindrical portions of the basic shaft 10.

The bearing portions 17 are configured with a diameter that is smaller than the smallest diameter of the mating tooth geometry 14 in the sliding element 11. By virtue of the supporting bearing 16 configured according to the invention, the advantage is afforded that the sliding element 11 can be pushed onto the basic shaft 10 in the direction of the shaft axis, and the supporting bearing 16 with the bearing collars 15, which are substantially cylindrical and run against cylindrical bearing portions 17, can provide a plain bearing with minimal play and minimal wear for radially guiding the sliding element 11 on the basic shaft 10.

Corresponding to the positions of the external teeth 13 on the basic shaft 10, the bearing collars 15 can be configured with mounting notches 20 which extend axially parallel in the axial direction and correspond to the circumferential position of the external teeth 13. When the sliding element 11 is pushed onto the basic shaft 10, the external teeth 13 can be made to overlap the mounting notches 20 in the bearing collars 15, such that the sliding element 11 can be mounted on the basic shaft 10 despite the greater external diameter of the external teeth 13 in relation to the diameter of the bearing collars 15. The bearing collars 15, configured substantially as hollow cylinders with the mounting notches 20 as small interruptions, are not impeded by the mounting notches 20 in their guiding function for radially guiding the sliding element 11 on the basic shaft 10 over the bearing portions 17.

Figure 2B:
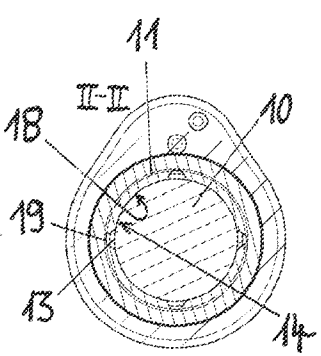
FIG. 2*b* is a sectional view of the example camshaft of FIG. 2 taken across line II-II.
Figure 2:
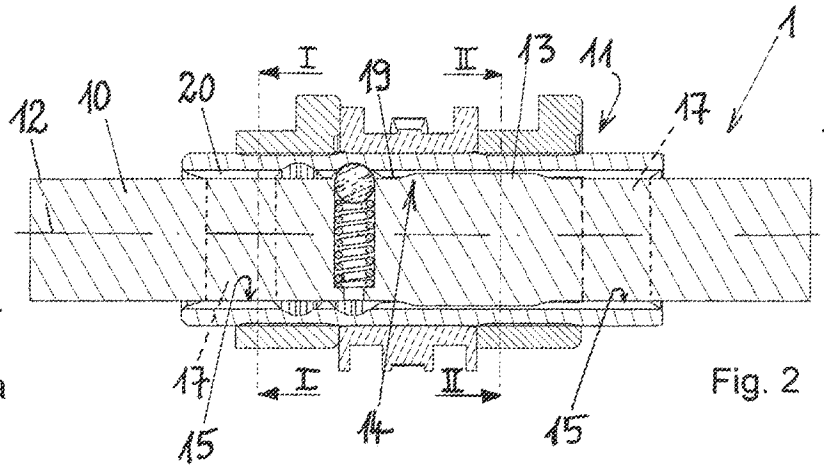
FIG. 2 is a cross-sectional view of another example camshaft.

FIG. 2 shows a cross section through a camshaft 1 with a basic shaft 10 and a sliding element 11, and the sliding element 11 is axially movable on the basic shaft 10 in the direction of the shaft axis. The cross-sectional view of the basic shaft 10 shows a transition of the bearing portions 17 into the area of the basic shaft 10 in which the external teeth 13 are formed, which extend into the mating tooth geometry 14 in the sliding element 11. The mating tooth geometry 14 in this case comprises tooth notches 19 which are formed in a hollow cylindrical portion which is not depicted by reason of the section plane, and reference is made to FIG. 3 in which the hollow cylindrical portion 18 is shown.

The bearing collars 15 of the sliding element 11 run against the bearing portions 17, and the sectional view shows mounting notches 20 which are formed in the bearing collars and which correspond to the circumferential position of the external teeth 13, such that the sliding element 11 can be pushed onto the basic shaft 10.

Figure 2A:
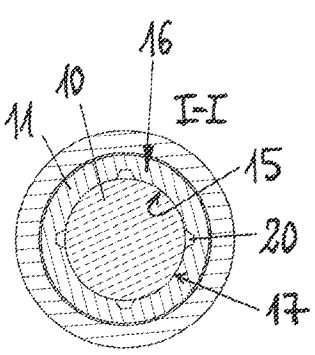
FIG. 2*a* is a sectional view of the example camshaft of FIG. 2 taken across line I-I.

FIG. 2*a* shows a cross-sectional view along the section line I-I, as shown in FIG. 2. The view shows the basic shaft 10 in the area of the bearing portion 17, and it also shows four mounting notches 20, distributed uniformly on the circumference, in the bearing collar 15 of the sliding element 11. Despite the mounting notches 20, a supporting bearing 16 between the sliding element 11 and the basic shaft 10 is created substantially in the manner of a plain bearing which allows the sliding element 11 to be guided on the basic shaft 10 with minimal play and with load-bearing capacity, without the sliding element 11 having to be guided via the meshing between the external teeth 13 and the mating tooth geometry 14, which serves only for the transmission of torque. In this way, particularly good run-out accuracy of the sliding element 11 on the basic shaft 10 is achieved.

FIG. 2*b* shows a cross-sectional view along the section line II-II, as shown in FIG. 2. The basic shaft 10 is shown sectioned in the area in which the basic shaft 10 comprises the external teeth 13, and the external teeth 13 extend into the tooth notches 19 formed in the hollow cylindrical portion 18 of the sliding element 11. The mating tooth geometry 14 is formed with the hollow cylindrical portion 18 and the tooth notches 19, and four tooth notches 19 are provided in uniform distribution on the circumference and correspond to likewise four external teeth 13. The circumferential positions of the tooth notches 19 match the circumferential positions of the mounting notches 20 in the bearing collars 15, as is shown in FIG. 2*a*.

Figure 3:
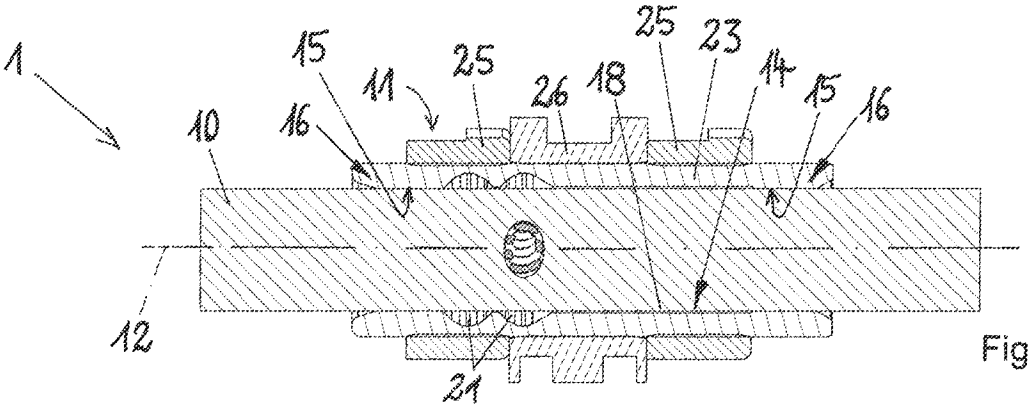
FIG. 3 is a cross-sectional view of the example camshaft of FIG. 2 in a section plane rotated about a shaft axis.

FIG. 3 shows a cross-sectional view of the camshaft 1 according to FIG. 2, in a section plane rotated about the shaft axis 12. This plane shows the hollow cylindrical portion 18 in the passage of the sliding element 11, which transitions laterally into the bearing collar 15 and into the latch grooves 21 which, in their axial continuation, transition into the wider bearing collar 15.

The sliding element 11 comprises a carrier tube 23 on which cam elements 25 and an adjustment member 26 for axially adjusting the sliding element 11 are formed. The bearing collars 15 for forming the supporting bearing 16 are introduced internally in the carrier tube 23, and the cam elements 25 and the adjustment member 26 can be pressed individually or together onto the outside of the carrier tube 23.

The cross-sectional views of FIGS. 2 and 3 show that the cylindrical bearing portions 17 of the basic shaft 10 are configured with a diameter that is smaller than the smallest diameter of the mating tooth geometry 14 in the sliding element 11. This allows the sliding element 11 to be mounted on the basic shaft 10, while at the same time the bearing portions 17 for radially guiding the sliding element 11 can have a cylindrical configuration, while only the bearing collar 15 comprises individual mounting notches 20 through which the external teeth 13 can run when the sliding element 11 is mounted on the basic shaft 10. By means of external teeth 13 provided only individually on the circumference, and associated tooth notches 19, the sliding element 11 can be supported radially on the basic shaft 10 with minimal wear and with load-bearing capacity, without the bearing having to take place on the tooth tips of the outer tooth geometry of the basic shaft 10.

The invention is not limited in terms of its design to the preferred embodiment described above. Rather, numerous variants are conceivable which make use of the presented solution even in fundamentally different embodiments. All of the features and/or advantages that emerge from the claims, from the description or from the drawings, including design details or spatial arrangements, may be essential to the invention both individually and in a wide variety of combinations.

LIST OF REFERENCE SIGNS

1 camshaft
10 basic shaft
11 sliding element
12 shaft axis
13 external tooth
14 mating tooth geometry

15 bearing collar
16 supporting bearing
17 bearing portion
18 hollow cylindrical portion
19 tooth notch
20 mounting notch
21 latch groove
22 latching element
23 carrier tube
24 compression spring
25 cam element
26 adjustment member

What is claimed is:

1. A camshaft comprising:

a sliding element with axial end faces, wherein the sliding element comprises on each of the axial end faces a bearing collar; and a shaft that receives the sliding element such that the sliding element is axially displaceable along a shaft axis, the shaft comprising an external tooth for transmitting torque between the shaft and the sliding element, wherein the external tooth engages a mating tooth geometry formed in a passage of the sliding element, wherein the bearing collars with the shaft form radial supporting bearings of the sliding element on the shaft, the shaft further comprising cylindrical bearing portions that form the radial supporting bearings, wherein a diameter of the cylindrical bearing portions is smaller than a diameter circumscribed by tips of the mating tooth geometry that protrude into the passage.

2. The camshaft of claim 1 wherein the mating tooth geometry comprises a hollow cylindrical portion with a tooth notch, wherein the external tooth of the shaft engages the tooth notch of the hollow cylindrical portion.

3. The camshaft of claim 2 wherein the bearing collars of the sliding element comprise a bearing internal diameter that is smaller than an internal diameter of the hollow cylindrical portion.

4. The camshaft of claim 2 wherein the cylindrical bearing portions of the shaft have an external diameter that is smaller than an internal diameter of the hollow cylindrical portion in the sliding element.

5. The camshaft of claim 1 wherein at least one of the bearing collars comprises a mounting notch, wherein the external tooth of the shaft is guided through the mounting notch as the sliding element is guided onto the shaft.

6. The camshaft of claim 5 wherein the mating tooth geometry comprises a hollow cylindrical portion with a tooth notch, wherein the external tooth of the shaft engages the tooth notch of the hollow cylindrical portion, wherein the tooth notch and the mounting notch are at mutually identical circumferential positions in the sliding element and are aligned with one another in a direction of the shaft axis.

7. The camshaft of claim 1 wherein a length of the external tooth as measured along the shaft axis is less than a distance between the bearing collars of the sliding element.

8. The camshaft of claim 1 further comprising at least two latch grooves disposed in the passage of the sliding element between one of the bearing collars and the mating tooth geometry, wherein a latching element that is received on the shaft is configured to latch into the at least two latch grooves.

9. The camshaft of claim 1 wherein an external diameter of a portion of the shaft where the external teeth is disposed is equivalent to an external diameter of the bearing portions.

10. The camshaft of claim 1 wherein the sliding element comprises a carrier tube, wherein the bearing collars are formed on the axial end faces of the carrier tube.

* * * * *